US012571180B2

(12) United States Patent
Kean et al.

(10) Patent No.: US 12,571,180 B2
(45) Date of Patent: Mar. 10, 2026

(54) CONTROLLING AN EXCAVATION OPERATION BASED ON LOAD SENSING

(71) Applicant: LEICA GEOSYSTEMS TECHNOLOGY A/S, Odense Sø (DK)

(72) Inventors: Michael Goulet Kean, Odense C (DK); Adnan Kanaan, Svendborg (DK); Sean Costello, Altstätten (CH); Tommi Juhani Kauppinen, Odense C (DK)

(73) Assignee: LEICA GEOSYSTEMS TECHNOLOGY A/S, Odense Sø (DK)

( * ) Notice: Subject to any disclaimer, the term of this patent is extended or adjusted under 35 U.S.C. 154(b) by 300 days.

(21) Appl. No.: 18/525,527

(22) Filed: Nov. 30, 2023

(65) Prior Publication Data

US 2024/0200302 A1 Jun. 20, 2024

(30) Foreign Application Priority Data

Dec. 20, 2022 (EP) ..... 22215077

(51) Int. Cl.
*E02F 3/43* (2006.01)
*E02F 9/26* (2006.01)

(52) U.S. Cl.
CPC ..... *E02F 3/437* (2013.01); *E02F 3/43* (2013.01); *E02F 3/439* (2013.01); *E02F 9/264* (2013.01)

(58) Field of Classification Search
CPC ... E02F 3/42; E02F 3/422; E02F 3/425; E02F 3/43; E02F 3/431; E02F 3/432;
(Continued)

(56) References Cited

U.S. PATENT DOCUMENTS 11,346,086 B1 * 5/2022 Kikani ..... E02F 9/2041
2020/0024828 A1 * 1/2020 Asada ..... E02F 3/437
(Continued)

FOREIGN PATENT DOCUMENTS

CN 108867725 A * 11/2018 ..... E02F 3/43
CN 108999228 A 12/2018
WO 2005/103396 A1 11/2005

OTHER PUBLICATIONS

Extended European Search Report dated May 19, 2023 as received in Application No. 22215077.3.

*Primary Examiner* — Ramya P Burgess
*Assistant Examiner* — Sara J Lewandroski
(74) *Attorney, Agent, or Firm* — Maschoff Brennan

(57) ABSTRACT

Automation and/or operator assistance in an excavation operation to obtain a design surface that makes use of resistance data indicative of a resistance exerted on an end effector of the excavator when it engages material to be moved. Control commands for maneuvering the end effector are mapped to movement commands for the end effector according to a first and a second conversion rule. Digging under the first conversion rule causes the end effector to move according to a target path derived from the design surface, whereas digging under the second conversion rule causes the end effector to move as a function of the resistance data and a digging efficiency criterion, which allows to move the end effector independently from the target path. The automation and/or operator assistance automatically transitions from the first conversion rule to the second conversion rule as a function of the resistance data.

18 Claims, 3 Drawing Sheets

(58) Field of Classification Search
CPC . E02F 3/434; E02F 3/435; E02F 3/437; E02F 3/438; E02F 3/439; E02F 9/26; E02F 9/261; E02F 9/262; E02F 9/264; E02F 9/265; B60W 2050/0062; B60W 2050/007; B60W 2050/0071; B60W 2050/0073; B60W 2050/0074; B60W 2050/0075; B60W 2050/009; B60W 2050/0091; B60W 2050/0094; B60W 2050/0095; B60W 2050/0096; B60W 60/005; B60W 60/0053; B60W 60/0055; B60W 60/0061
See application file for complete search history.

(56) References Cited

U.S. PATENT DOCUMENTS

| | | | | |
|---|---|---|---|---|
| 2020/0240116 | A1* | 7/2020 | Cheng | E02F 9/2045 |
| 2022/0170233 | A1* | 6/2022 | Ono | E02F 3/437 |
| 2023/0034265 | A1* | 2/2023 | Renner | E02F 9/264 |
| 2023/0243130 | A1* | 8/2023 | Aizawa | E02F 3/437 37/348 |
| 2024/0027978 | A1* | 1/2024 | Song | G05B 13/048 |

* cited by examiner

CONTROLLING AN EXCAVATION OPERATION BASED ON LOAD SENSING

BACKGROUND

The present disclosure relates to automation and/or operator assistance in an excavation operation to obtain a design surface.

Excavation operations often have to be carried out efficiently, but also precisely. Poorly executed excavation, e.g. violating the design surface by digging into/below it, can lead to increased material costs and delayed work processes. Precisely digging/clearing a design surface often requires a skilled operator of the excavator, able to simultaneously provide a variety of input commands to move the end effector. Required input commands may change for different situations defined by the excavator position, the excavator orientation, and the geometry of the design surface. Thus, the operator has to adapt to different geometries and orientations of the excavator and the end effector.

Excavators are often equipped with automation and assistance systems configured to assist the operator in order to generate a finished surface. By way of example, such assistance systems are configured to restrict or remap input commands for moving the end effector as a function of the geometry of the design surface (and the excavator positioning). For example, the assistance system may be configured to enforce parallel movements of the end effector relative to the ground or relative to the design surface.

Often the use of the assistance system is limited to operating very near to a design surface, such that the operator is only assisted during the final pass. Gross excavation to remove the material above grade has to be executed manually, which, for example, could still provoke digging into/below the design surface. For example, this is because existing systems often operate in a so-called kinematic capacity, wherein the operation is based on the position and trajectory of the end effector. A purely-kinematic assistance system cannot account for material interaction, which largely dictates the required motion during gross excavation.

In an operation like trenching, an automation and assistance system requiring the operator to perform gross excavation manually, may not be the ideal workflow as the system is inactive for the majority of the excavation.

Alternative automated digging strategies are based on scanning the surface of the soil and planning a digging pass by using the rated volume of the bucket, the soil surface profile, and algorithmically determined metrics for generating a path that sweeps a desired volume of material.

These methods suffer from reduced bucket fill when loads get sufficiently large that the planned path cannot be followed. Because of this, these approaches are unable to provide bucket fill that is consistent with what an experienced operator could achieve.

SUMMARY

It is therefore an object of the present disclosure to provide improved excavation to a design surface.

A further object is to provide a more efficient excavation while reducing the amount of faulty excavation steps.

A further object is to provide easier control of an excavator, e.g. such that pressure on an excavator operator and/or the skill level of an excavator operator can be reduced.

The disclosure relates to a method for controlling an excavation operation by an excavator to obtain a design surface. The method comprises accessing design data providing shape and location information of the design surface and accessing control commands for maneuvering an end effector, e.g. a bucket, of the excavator. The method further comprises accessing resistance data indicative of a resistance exerted against the end effector when it engages material to be moved by the excavator. For example, the resistance is caused by the material to be moved against the end effector when the end effector presses against the material to be moved and/or the resistance is caused by adhesive resistance from the material as the end effector is moved through the material to be moved.

A first conversion rule is provided, configured to map the control commands to movement commands for the end effector, which cause the end effector to move according to a target path derived from the design surface. For example, the target path runs at least in sections parallel to the design surface. A second conversion rule is provided, configured to map the control commands to movement commands for the end effector as a function of the resistance data and a digging efficiency criterion, e.g. a criterion for assessing a time evolution of the resistance data. The second conversion rule is different from the first conversion rule and allows to move the end effector independently from the target path, wherein the method further comprises transitioning from the first conversion rule to the second conversion rule as a function of the resistance data.

In other words, one aspect relates to providing an automation and assistance system over a larger operating envelope. For example, thanks to the inclusion of resistance data, e.g. of a load sensing mechanism as described below, an operator is provided with the option to leverage the automation system during nearly the entirety of a trenching operation.

By way of example, the resistance data provide information on forces exerted on the end effector and the directions in which the forces act in relation to at least two, e.g. three, different directions. Alternatively or in addition, the resistance data provide information on a moment exerted on the end effector, which is caused by the end effector pressing onto the material to be moved and/or by the end effector moving through the material to be moved.

For example, the resistance data provide for a sensing or predicting of a load being applied on the end effector due to a digging interaction between the end effector and the soil. This is distinct from a payload weighing system of the prior art, which, for example, calculates the weight of material in the excavator bucket. For example, existing payload weighing systems use the pressure in the boom cylinders to calculate the moment about the pin joint between the boom and the chassis, estimate and correct for a moment due to cylinder drag, and then calculate the necessary bucket load to generate the moment. In contrast, resistance data provide for measuring the loading conditions on the end effector during digging, which may include forces and moments in three directions. These digging loads are highly dynamic and cannot be calculated in a straight forward and sufficiently accurate manner using the same methods as a basic payload weighing system.

The resistance will depend on a speed of the end effector, e.g. wherein faster speeds will increase the resistance. Therefore, in one embodiment the transitioning from the first conversion rule to the second conversion rule further depends on a speed parameter indicative of a speed of the end effector.

The combination of speed and path is often referred to as "trajectory". In a further embodiment, the first and/or the second conversion rule includes a control of a speed of the end effector as a function of the resistance data. By way of example, according to the first conversion rule, the speed at which the end effector is moved along the target path is controlled as a function of the resistance data. Similarly, according to the second conversion rule, the speed at which the end effector is moved along a defined spatial direction is controlled as a function of the resistance data. For example, the end effector may be controlled to dig more slowly in very tough material. Alternatively or in addition, a speed requested on the basis of the control commands by the operator is limited, such that the resistance stays below a threshold resistance.

In a further embodiment, the transitioning is carried out based on a threshold criterion for a resistance force and/or a resistance moment being exerted on the end effector when it engages material to be moved by the excavator. For example, the threshold criterion is associated with providing a defined accuracy for following the target path by the end effector according to the first conversion rule. Alternatively or in addition, the threshold criterion is associated with providing a limit on an allowable force acting on a joint of an excavator component that provides movement of the end effector. By way of example, the threshold criterion limits forces applied to the boom, joints, or implements, thus reducing wear and tear and increasing lifespan of the equipment and preventing break downs.

In a further embodiment, the method comprises a stopping of the second conversion rule on the basis of a user command and/or as a function of the resistance data, thereby releasing an original assignment of the control commands into movement commands for the end effector. For example, this allows a seamless transition from a controlled end effector movement into full freedom of movement, e.g. at the end of the pass.

By way of example, before releasing the original assignment of the control commands the operator has to manually operate the boom and bucket in a way to ensure that material falls into the bucket and is lifted clear of the excavation. Alternatively, an automated system may be provided such that in further step, an (e.g. automated) orienting of the end effector into a defined (safe) hold orientation before the releasing of the original assignment of the control commands is carried out.

In a further embodiment, the stopping of the second conversion rule is initiated by the control commands indicating a defined curl movement of the end effector. Alternatively or in addition, the stopping of the second conversion rule is initiated by recognizing that the resistance data indicate that the end effector is lifted out of material to be moved by the excavator. For example, a lifting out of the material to be moved is indicated by a sudden drop of a resistance force exerted on the end effector. The stopping may also be initiated by a history of the resistance data of a current pass of the end effector and a pass termination criterion, which provides indication as a function of the history of the resistance data that the current pass has reached a defined progress. Another option is an initiation by a further threshold criterion for a resistance force and/or a resistance moment being exerted on the end effector when it engages material to be moved, e.g. wherein the further threshold criterion indicates that a load has grown too large for the excavator to sustain forward motion.

While the first conversion rule enforces a following of a defined target path by the end effector, the second conversion rule provides more freedom to move the end effector. However, the second conversion rule still enforces some automation or coordination of the movement of the end effector to ensure digging according to the digging efficiency criterion.

By way of example, the digging efficiency criterion provides at least one of: maximizing power applied by a cut region of the end effector onto material to be moved by the excavator; minimizing path deviation of a path of the end effector; minimizing a resistance force exerted onto the end effector in a defined direction; minimizing a resistance moment exerted onto the end effector; maintaining a target resistance force and/or a target resistance moment exerted on the end effector; and maintaining an orientation of the end effector such that the material to be moved is cut by teeth of the end effector.

In a further embodiment, the target path is sequentially changed according to the first conversion rule, thereby providing a sequence of target paths to be excavated one after the other. The sequence is derived from the design surface and incrementally approaches the design surface. For example, each of the different target paths runs at least in sections parallel to the design surface. In other words, the target paths are processed one after the other, wherein a following by the end effector of a target path further downstream of the sequence requires that the end effector completes following of the immediately preceding target path.

In a further embodiment, the method comprises a determining of the target path as a path parallel to the design surface at a current penetration depth of the end effector into the material to be moved and a triggering of the first conversion rule when the control commands indicate a movement of the end effector parallel to the design surface.

By way of example, an advantage of load based digging is that it allows to smoothly/automatically handle the question of, How deep a cut can I take?" rather than letting an operator guess how deep a cut can be made, which, for example, often leads to either stalling or cutting too shallow. The inventive method thus allows the operator to engage the machine in the cut, wherein the engagement triggers an automatic generation of a target path parallel to the design surface at the current bucket depth.

Alternatively or in addition, the method may include a monitoring of the load data and an automatic detection when the end effector is suitably engaged in the soil. This could then be used to trigger generation of a target path parallel to the design surface at the current depth, and transitioning from manual to automatic control is triggered upon determining that the end effector is suitably engaged in the soil.

In a further embodiment, the method comprises a determining of the target path as a path parallel to the design surface at a current penetration depth of the end effector into the material to be moved and a triggering of the first conversion rule based on a monitoring of the resistance data and an engagement criterion as a function of the resistance data.

In a further embodiment, according to the first conversion rule the target path lies in the design surface. In case the design surface intersects a material surface of material to be moved by the excavator, an excavation pass is started by activating the first conversion rule, such that first contact of the end effector with the material to be moved is provided at a point on the design surface.

The disclosure further relates to a system for controlling an excavation operation by an end effector of an excavator to obtain a design surface. The system is configured to carry out the method described above, for which it comprises a computing unit configured: to access the design data and the control commands of the steps of accessing design data and control commands as described above; to access the resistance data of the step of accessing resistance data as described above; to provide the first and the second conversion rule according to the steps of providing the first conversion rule and providing the second conversion rule as described above; and to evaluate the resistance data to provide the transitioning according to the above described step of transitioning from the first conversion rule to the second conversion rule.

In one embodiment, the system further comprises a sensor unit configured to be mounted on an excavator and—in a state mounted to the excavator—to provide the resistance data. By way of example, the sensor unit is configured to provide a vector measurement of a force exerted on the end effector, wherein the vector measurement is provided with respect to at least two, e.g. three, different directions.

For example, the sensor unit comprises multiple distributed sensors such as IMUs and pressure sensors, and a sophisticated algorithm processing the sensor data to yield estimates on a force and/or moment applied on the end effector caused by the end effector contacting (e.g. pressing onto) the material to be moved.

In a further embodiment, the system comprises a perception sensor configured to generate perception data, e.g. in 3D, wherein the system is configured to use the perception data to evaluate whether the design surface intersects a material surface of material to be moved by the excavator. Thus, for example, the system is configured to provide a starting point of an excavation pass such that it is ensured that first contact of the end effector with the material to be moved is provided at a point on the design surface, e.g. to execute the method according to the above-described embodiment, wherein the target path lies in the design surface.

The disclosure further relates to a computer program product comprising program code which is stored on a machine-readable medium, or being embodied by an electromagnetic wave comprising a program code segment, and has computer-executable instructions for performing, in particular when run on a computing unit of a system described above: accessing the design data and the control commands of the steps of accessing design data and control commands as described above; accessing the resistance data of the step of accessing resistance data as described above; providing the first and the second conversion rule according to the steps of providing the first conversion rule and providing the second conversion rule as described above; and evaluating the resistance data to provide the transitioning according to the step of transitioning from the first conversion rule to the second conversion rule as described above.

In particular, the program code comprises computer-executable instructions for performing any step in the method as described above.

BRIEF DESCRIPTION OF THE DRAWINGS

The method, system, and computer program product according to the different aspects are described or explained in more detail below, purely by way of example, with reference to working examples shown schematically in the drawing. Identical elements are labelled with the same reference numerals in the figures. The described embodiments are generally not shown true to scale and they are also not to be interpreted as limiting. Specifically.

DETAILED DESCRIPTION

Figure 1:
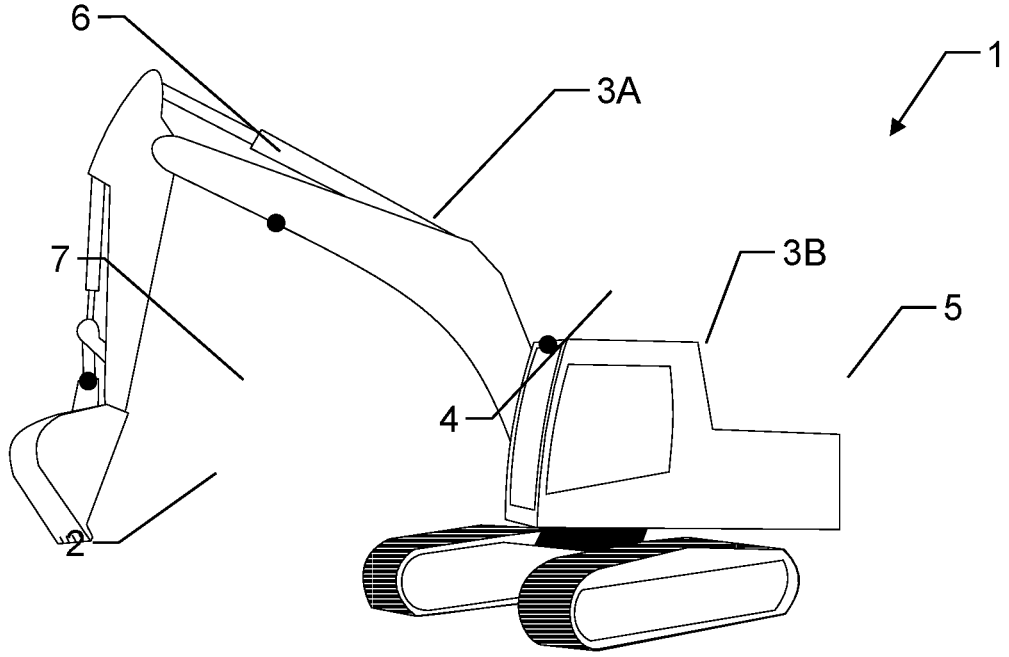
FIG. 1: an exemplary embodiment of an excavator, which can be embodied or upgraded to work.

FIG. 1 shows an exemplary embodiment of an excavator 1, which can be embodied or upgraded to work according to the method described above. A computing unit mounted on the excavator 1 has access to a sensor unit configured to provide resistance data indicative of a resistance force exerted on the bucket 2 of the excavator when engaging with material to be moved by the excavator.

The system may further comprise a perception sensor configured to generate perception data, wherein mounting locations 3A, 3B for the perception sensor may be somewhere on the boom 4 of the excavator and/or on the cabin 5. The data recorded by the perception unit are used to evaluate whether the design surface intersects a material surface of the soil. For example, in an embodiment the perception unit comprises at least one camera. In another embodiment, the perception unit comprises a 3D coordinate measuring device, e.g. embodied as a laser scanner.

By way of example, the sensor unit provides kinematic information for different parts of the excavator and information regarding the effects of (e.g. external) forces acting on different parts of the bucket 2 when interacting with the soil, e.g. provided by a torque or force sensor monitoring a bucket joint.

The first and the second conversion rules map control commands for moving parts of the excavator, e.g. a boom 4, a stick 6, a rotating cabin 5, and a bucket joint 7, to specific movements that ensure movement of the bucket according to the first and the second conversion rule, respectively.

Figure 2:
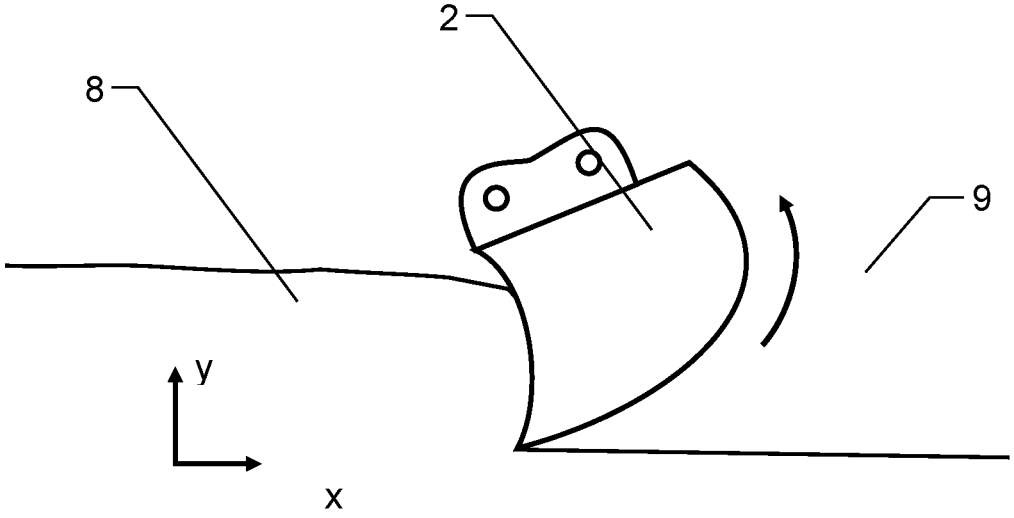
FIG. 2: exemplary forces captured by the resistance data when the bucket engages with the soil.

FIG. 2 exemplarily indicates possible forces and moments captured by the resistance data when the bucket 2 engages with the soil 8, e.g. a load acting on the bucket 2 from the soil 8 in the x-direction, a load acting on the bucket 2 from the soil 8 in the y-direction, and a moment 9 (acting on the bucket in the z direction, perpendicular to x and y).

Figure 3:
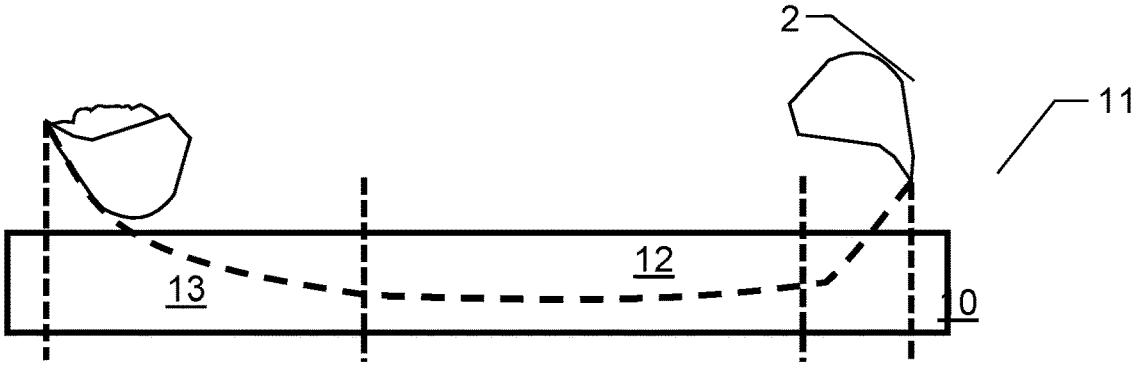
FIG. 3: schematically depicts an exemplary semi-automatic workflow according to a first embodiment of the inventive method.

FIG. 3 schematically depicts an exemplary semi-automatic workflow according to a first embodiment of the inventive method. In a penetration phase 10, the operator brings the blade 11 of the bucket 2 to the desired depth with the desired attack angle, then initiates semi-automatic digging by pulling in the stick only. In a scraping phase 12, the operator pulls the stick joystick, wherein the bucket trajectory is automatically controlled by the first conversion rule to follow a horizontal path with maximum digging efficiency, e.g. defined as speed times force equals target digging power. In an exit phase 13 implementing the second conversion rule, the operator raises the boom, curls the bucket, and is given back control of the stick according to the original assignment of the control commands of the excavator. In this handover phase, the semi-automatic system ensures there is no overdig due to the bucket curl. In order to complete the digging, the operator simply executes successive digging passes until the system achieves the desired design surface.

Figure 4:
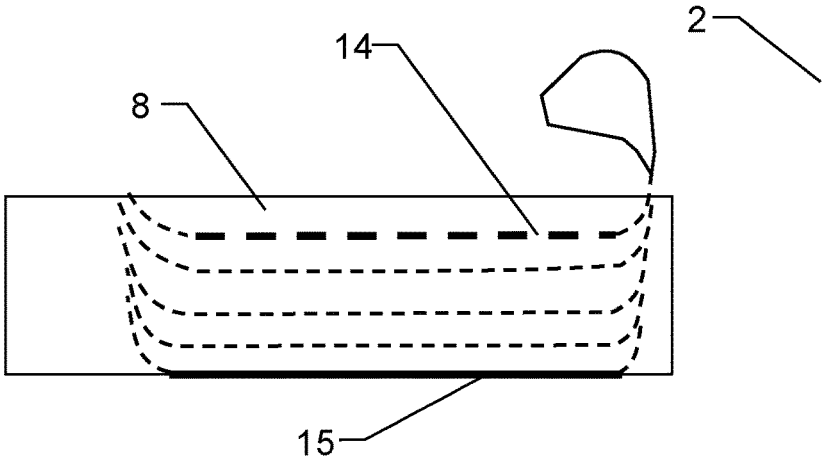
FIG. 4: schematically depicts a second embodiment of the inventive method providing for incrementally digging parallel to the design surface.

FIG. 4 schematically depicts a second embodiment, wherein the first conversion rule provides for incrementally digging parallel to the desired design surface. Here, the operator positions the cutting edge of the bucket 2 at the start of a cutting pass and penetrates the soil to the desired depth. The operator pulls in on the arm command and the first conversion rule ensures that the bucket 2 generates a path following a target path 14 at the desired depth, parallel to the design surface 15. As soon as the resistance data indicate that accurately following the target path cannot be maintained, the automated system transitions into the second conversion rule and provides lifting of the bucket 2 in an efficient way as a function of a digging efficiency criterion, e.g. wherein: efficient digging is maximizing power applied in the cut, efficient digging is optimized to minimize the path deviations due to variations in loading, efficient digging is optimized to minimize the loads in a given direction, efficient digging is optimized to maintain the vehicle at a target load level (hydraulic load, engine load, or both), and/or efficient digging is optimized so that the load is characteristic of the bucket teeth and ears cutting the soil rather than the cutting edge. For example, efficient digging may be using an admittance based control scheme in place of a kinematic control scheme.

At the end of the pass the operator is given back control according to the original assignment of the control commands of the excavator and manually operates the boom and bucket to ensure the material falls into the bucket and is lifted clear of the excavation.

Figure 5:
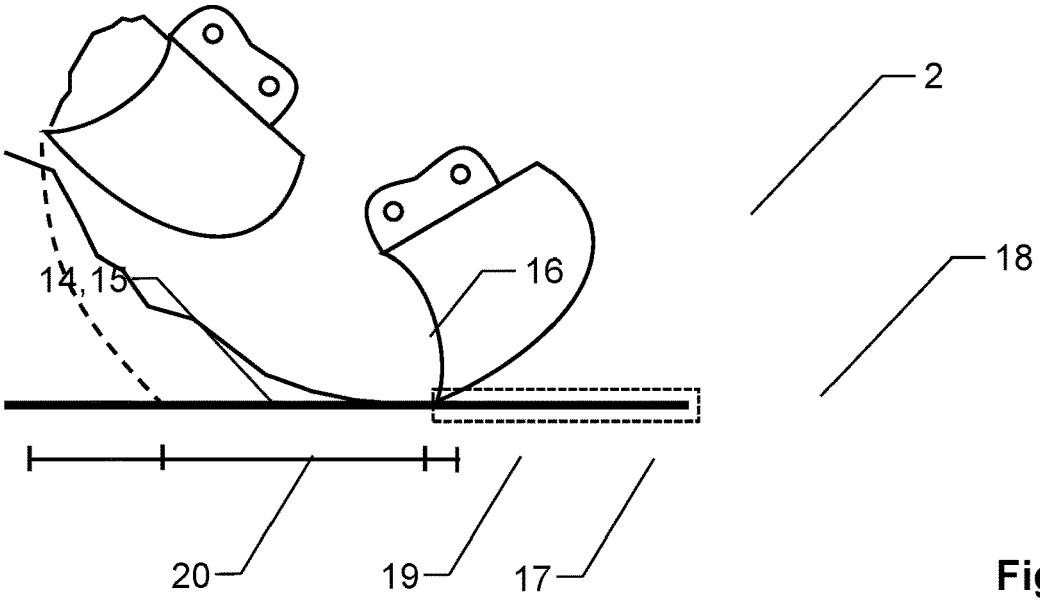
FIG. 5: schematically depicts a third embodiment of the inventive method providing for incrementally advancing of the desired design surface.

FIG. 5 schematically depicts a third embodiment, e.g. for excavating a trench, wherein the first conversion rule provides for incrementally advancing of the desired design surface 15. Here, each excavation cycle starts with locating the machine to begin excavating the trench. This requires the dig plane of the excavator to be parallel to or perpendicular to the trench direction. Typically, the excavator is positioned such that the workspace of the bucket cutting edge includes the extreme position of the trench. The assistance system according to this embodiment determines whether the design surface 15 intersects the soil surface, e.g. by means of a visual perception sensor such as a 2D or 3D surveying unit. If the design surface 15 does not intersect the soil surface, a pre-excavation is required to reach the design surface. If the design surface 15 intersects the soil surface, the operator positions the bucket 2 such that it can begin cutting where the design surface 15 meets the existing surface 16 of the soil. The automated system activates the first conversion rule, wherein in this embodiment the first conversion rule makes sure that the target path 14 lies in the design surface 15, i.e. the cutting edge of the bucket 2 follows the design surface 15. Upon engaging the soil by the operator pulling in on the arm command, the automated system coordinates the arm and boom in order to provide cutting along the design surface.

The coordination of the arm and boom is altered depending on the resistance data, wherein the assistance system automatically switches into the second conversion rule. According to the second conversion rule, for example, the coordination is based on maintaining even loading across the boom and arm hydraulic circuits. For example, the coordination is based on the sensed direction of the load on the bucket, e.g. a strong load resisting the motion of the bucket may result in a larger boom command to decrease the cutting depth and lessen the load. The coordination according to the second conversion rule further guarantees that the cutting edge moves away from the design surface 15 rather than penetrating it.

By way of example, the first and second conversion rules are interrelated in a superpositioning manner, wherein the first conversion rule is used as a primary mapping rule and the second conversion rule provides additional mapping rules for moving the bucket away from the design surface "superimposed" upon the rules of the first conversion rule in an additive manner.

At the end of the pass, the operator steers the bucket out of the soil, executes the dumping portion of the dig cycle, and the assistance system initiates the next cycle by locating where the design surface meets the existing surface of the soil and so forth.

When the excavator has excavated enough material that the cycle cannot be continued with the existing track location, the operator steers the excavator to advance the tracks. When cutting parallel to the tracks, this occurs as the excavation approaches the machine and is too near the front of the tracks for cutting to continue. The excavator must then travel in reverse so that the surface of the soil 16 is sufficiently far from the swing axis for efficient digging to resume. When cutting perpendicular to the tracks, this occurs when the full cross section of the desired surface 15 has been cut for the cross section perpendicular to the tracks. In this case, the machine tracks along the trench one bucket width and repeats the procedure.

By way of example, a digging cycle comprises a first phase 17, which occurs during the approach to the position where the design surface 15 meets the existing surface 16 of the soil, e.g. close to the area 18 wherein the design surface 15 has already been precisely formed by previous excavation cycles. Here, no load is detected and the rate of increase of the speed of the bucket 2 is limited to prevent overdig. In a second phase 19, occurring at the beginning of engaging with the soil, low load is detected and the cutting edge of the bucket 2 follows the design surface 15. In a third phase 20, higher load is encountered and the assistance system transitions to the second conversion rule and initiates a lifting and filling of the bucket 2 according to a defined digging efficiency criterion.

According to one aspect, the above described method provides for a workflow where each excavation cycle is executed using the automation system. The automation system automatically transitions from kinematically controlled digging (digging according to the first conversion rule) at the desired surface 15 to a load dependent digging (digging according to the second conversion rule) when the load becomes too large to maintain the accuracy required for final pass cutting accuracy. By way of example, the operator can add a single pass of entirely kinematic digging prior to advancing the tracks to ensure that the surface has been cut correctly.

Figure 6:
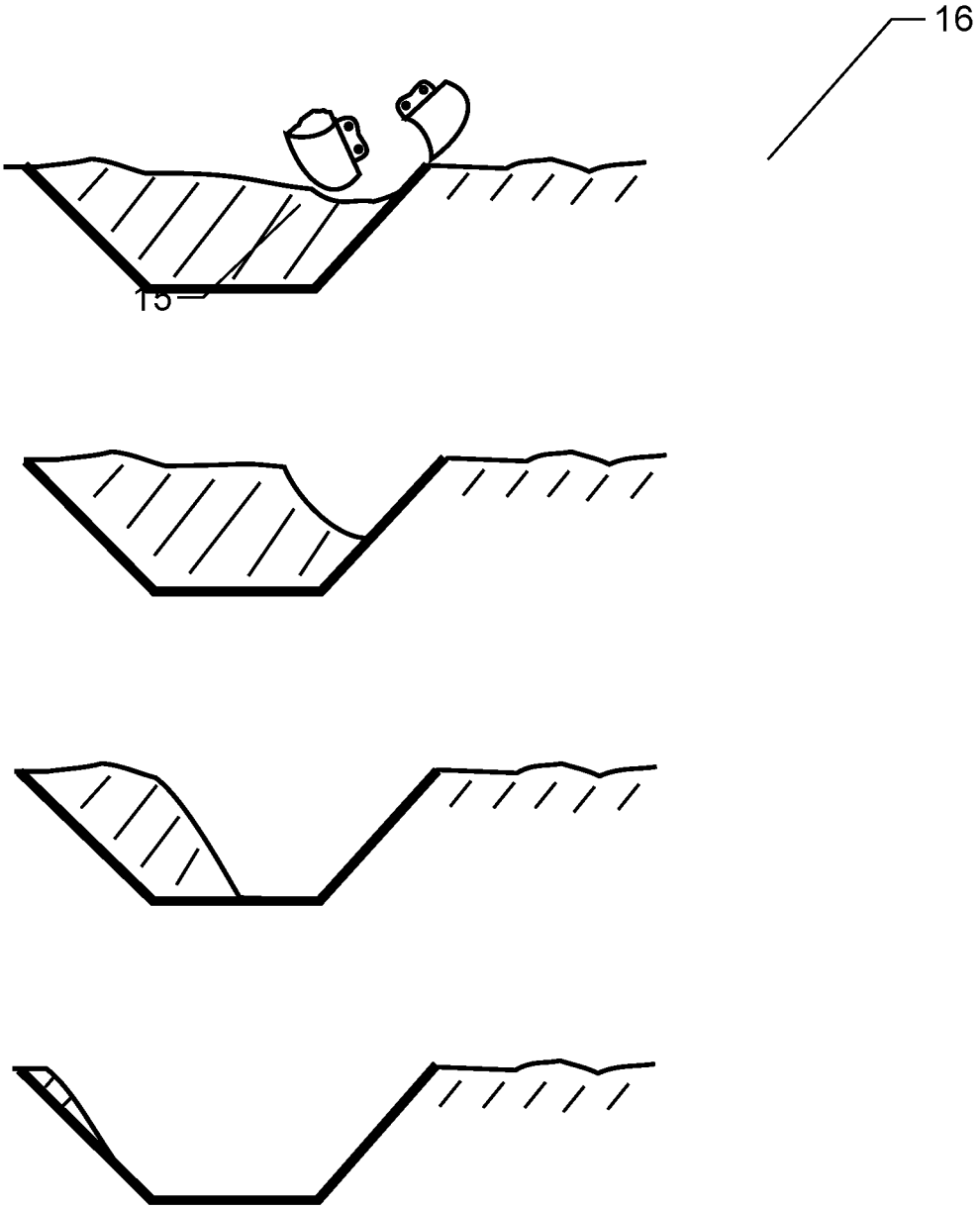
FIG. 6: schematically depicts a fourth embodiment of the inventive method providing for incrementally advancing of the desired design surface.

FIG. 6 schematically depicts another digging operation according to a fourth embodiment, wherein a digging progress is depicted from top to bottom of the figure. Similar to the digging operation described with reference to FIG. 5, the assistance and automation system is engaged as soon as any portion of the design surface 15 intersects the soil surface 16. The initial pass depicted at the top of the figure starts the excavation by uncovering some small portion of the design surface 15 under the first conversion rule and then converting to load based mass excavation under the second conversion rule. Every subsequent path extends the amount of the surface that has been cut to the desired profile and excavates additional material for the next pass. Eventually the machine is able to excavate the full profile.

The use of kinematically controlled digging (digging according to the first conversion rule) for each pass also provides a fully automated system with the opportunity to smoothly transition from the positioning step to the cutting step. The desired kinematic path sets the boundary conditions for the path generation to return the bucket from the dump location to the cutting location. It is trivial for the automation system to plan a path from the end of the dig cycle to the desired dump location, so a full dig cycle can now be planned with a typical kinematic method being used everywhere except a loading dependent path during the soil engagement. Since trenching is a largely linear operation, a fully autonomous system can also include simple rules to determine when to advance the tracks along the trench.

Although aspects are illustrated above, partly with reference to some preferred embodiments, it must be understood that numerous modifications and combinations of different features of the embodiments can be made. All of these modifications lie within the scope of the appended claims.

The invention claimed is:

1. A method for controlling an excavation operation by an excavator to obtain a design surface, wherein the method comprises accessing design data providing shape and location information of the design surface and accessing control commands for maneuvering an end effector of the excavator, accessing resistance data indicative of a resistance exerted against the end effector when it engages material to be moved, providing a first conversion rule configured to map the control commands to movement commands for the end effector, which cause the end effector to move according to a target path derived from the design surface, particularly wherein the target path runs at least in sections parallel to the design surface, providing a second conversion rule configured to map the control commands to movement commands for the end effector as a function of the resistance data and a digging efficiency criterion, wherein the second conversion rule is different from the first conversion rule and allows to move the end effector independently from the target path, and transitioning from the first conversion rule to the second conversion rule as a function of the resistance data.

2. The method according to claim 1, wherein the resistance data provide information on forces exerted on the end effector and the directions in which the forces act in relation to at least two, in particular three, different spatial directions.

3. The method according to claim 1, wherein the resistance data provide information on a moment exerted on the end effector, which is caused by the end effector pressing onto the material to be moved and/or by the end effector moving through the material to be moved.

4. The method according to claim 1, wherein the transitioning is carried out based on a threshold criterion for a resistance force and/or a resistance moment being exerted on the end effector when it engages material to be moved by the excavator, wherein the threshold criterion is associated with providing a defined accuracy for following the target path by the end effector according to the first conversion rule and/or wherein the threshold criterion is associated with providing a limit of an allowable force acting on a joint of an excavator component that provides movement of the end effector.

5. The method according to claim 1, comprising:

a stopping of the second conversion rule on the basis of a user command and/or as a function of the resistance data, thereby releasing an original assignment of the control commands into movement commands for the end effector, and comprising an orienting of the end effector into a defined hold orientation before the releasing of the original assignment of the control commands.

6. The method according to claim 5, wherein the stopping of the second conversion rule is initiated by at least one of:

the control commands indicating a defined curl movement of the end effector, recognizing that the resistance data indicate that the end effector is lifted out of material to be moved by the excavator, particularly indicated by a sudden drop of a resistance force and/or a sudden drop of a resistance moment exerted on the end effector, a history of the resistance data of a current pass of the end effector and a pass termination criterion, which provides indication as a function of the history of the resistance data that the current pass has reached a defined progress, and a further threshold criterion for a resistance force and/or a resistance moment being exerted on the end effector when it engages material to be moved.

7. The method according to claim 1, wherein the digging efficiency criterion provides at least one of:

maximizing power applied by a cut region of the end effector onto material to be moved by the excavator, minimizing path deviation of a path of the end effector, minimizing a resistance force exerted onto the end effector in a defined direction, minimizing a resistance moment exerted onto the end effector, maintaining a target resistance force and/or a target resistance moment exerted on the end effector, and maintaining an orientation of the end effector such that the material to be moved is cut by teeth of the end effector.

8. The method according to claim 1, wherein according to the first conversion rule, the target path is sequentially changed, thereby providing a sequence of target paths to be excavated one after the other, wherein the sequence is derived from the design surface and incrementally approaches the design surface, particularly wherein each of the different target paths runs at least in sections parallel to the design surface.

9. The method according to claim 1, comprising a determining of the target path as a path parallel to the design surface at a current penetration depth of the end effector into the material to be moved and a triggering of the first conversion rule when the control commands indicate a movement of the end effector parallel to the design surface, and/or a triggering of the first conversion rule based on a monitoring of the resistance data and an engagement criterion as a function of the resistance data.

10. The method according to claim 1, wherein according to the first conversion rule the target path lies in the design surface, wherein in case the design surface intersects a material surface of material to be moved by the excavator, an excavation pass is started by activating the first conversion rule, such that first contact of the end effector with the material to be moved is provided at a point on the design surface.

11. A system for controlling an excavation operation by an end effector of an excavator to obtain a design surface, wherein the system is configured to carry out the method of claim 1, for which it comprises a computing unit configured:

to access the design data and the control commands of the steps of accessing design data and control commands, to access the resistance data of the step of accessing resistance data, to provide the first and the second conversion rule according to the steps of providing the first conversion rule and providing the second conversion rule, and to evaluate the resistance data to provide the transitioning according to the step of transitioning from the first conversion rule to the second conversion rule.

12. The system according to claim 11, comprising a sensor unit configured to be mounted on an excavator and, in a state mounted to the excavator, to provide the resistance data, wherein the sensor unit is configured to provide a vector measurement of a force exerted on the end effector, wherein the vector measurement is provided with respect to at least two, in particular three, different directions.

13. The system according to claim 11, comprising a perception sensor configured to generate perception data, particularly in 3D, wherein the system is configured to use the perception data to evaluate whether the design surface intersects a material surface of material to be moved by the excavator.

14. A computer program product comprising program code which is stored on a machine-readable medium, or being embodied by an electromagnetic wave comprising a program code segment, and has computer-executable instructions for performing, when run on the computing unit of the system according to claim 11:

accessing the design data and the control commands of the steps of accessing design data and control commands, accessing the resistance data of the step of accessing resistance data, providing the first and the second conversion rule according to the steps of providing the first conversion rule and providing the second conversion rule, and evaluating the resistance data to provide the transitioning according to the step of transitioning from the first conversion rule to the second conversion rule.

15. A computer program product comprising program code which is stored on a non-transitory machine-readable medium, and has computer-executable instructions for performing, when run on the computing unit of the system according to claim 13:

accessing the design data and the control commands of the steps of accessing design data and control commands, accessing the resistance data of the step of accessing resistance data, providing the first and the second conversion rule according to the steps of providing the first conversion rule and providing the second conversion rule, and evaluating the resistance data to provide the transitioning according to the step of transitioning from the first conversion rule to the second conversion rule.

16. A computer program product comprising program code which is stored on a non-transitory machine-readable medium, wherein the program code comprises computer-executable instructions for performing any step in the method of claim 1.

17. A computer program product comprising program code which is stored on a non-transitory machine-readable medium, wherein the program code comprises computer-executable instructions for performing any step in the method of claim 6.

18. A computer program product comprising program code which is stored on a non-transitory machine-readable medium, wherein the program code comprises computer-executable instructions for performing any step in the method of claim 10.

* * * * *